US006879947B1

(12) United States Patent
Glass

(10) Patent No.: US 6,879,947 B1
(45) Date of Patent: Apr. 12, 2005

(54) METHOD FOR OPTIMIZING THE BIT DESIGN FOR A WELL BORE

(75) Inventor: Kevin L. Glass, Spring, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 957 days.

(21) Appl. No.: 09/705,569

(22) Filed: Nov. 3, 2000

Related U.S. Application Data

(60) Provisional application No. 60/163,227, filed on Nov. 3, 1999.

(51) Int. Cl.[7] ..... G06G 7/50

(52) U.S. Cl. ..... 703/10; 73/152.02; 73/152.03; 175/48

(58) Field of Search ..... 703/10; 73/152.02, 73/152.03, 152.43, 152.44; 175/27, 50, 48

(56) References Cited

U.S. PATENT DOCUMENTS 4,760,735 A * 8/1988 Sheppard et al. ..... 73/152.43
4,794,534 A * 12/1988 Millheim ..... 702/9
5,415,030 A * 5/1995 Jogi et al. ..... 73/152.03
5,465,798 A * 11/1995 Edlund et al. ..... 175/24
6,408,953 B1 * 6/2002 Goldman et al. ..... 175/39

OTHER PUBLICATIONS

The SPE Image Library, SPE 11380, entitled Torque and Drag in Directional Wells—Prediction and Measurement, copyright 1984 Society of Petroleum Engineers of AIME.

* cited by examiner

*Primary Examiner*—Albert W. Paladini
(74) *Attorney, Agent, or Firm*—Browning Bushman

(57) ABSTRACT

A drill bit is designed to achieve optimum performance in a specified drilling application defined by the drilling system, the formation to be drilled and the configuration of the bore hole. A depth of cut versus predicted torque for a basic bit configuration is evaluated for different configurations of the drill bit. A computer modeling program is used to obtain the predicted torque for the basic bit configuration, and its modifications. Features of the bit design are changed to achieve the lowest predicted torque for an optimum depth of cut. Presenting the computer analysis as depth of cut versus predicted torque for the bit design simplifies the design selection process. The formation being drilled may be evaluated by comparing actual torque with predicted torque for a given rate of penetration. The evaluation can be used to conform the computer model and determine formation properties.

33 Claims, 5 Drawing Sheets

METHOD FOR OPTIMIZING THE BIT DESIGN FOR A WELL BORE

CROSS REFERENCE TO RELATED APPLICATIONS

This application is related to and claims the benefit of the filing date of U.S. Provisional Application Ser. No. 60/163,227 filed Nov. 3, 1999.

BACKGROUND OF THE INVENTION

1. Field of the Invention

The present invention relates generally to the design of bits used for drilling bores through earthen formations. More particularly, the present invention relates to a method for optimizing the creation of a well bore using a bit designed to operate with a specified drilling system, formation structure and well bore trajectory.

2. Setting of the Invention

The prior art monitors real-time drilling conditions to optimize drilling effectiveness. Generally, the prior art method for optimizing drilling performance has not gone as far as designing an optimum bit for the given drilling system and formation requirements. The prior art has not attempted to optimize the performance of a bit by designing the bit to be most effective operating within the specific drilling parameters of a particular well. In the inventor's experience, prior art bit selection processes have not taken into account information about the drilling system and the formation of the drilling application and then proceeded to design a bit to work optimally within the parameters of the application. A comprehensive technical approach to handling bit selection is not generally taken. Bit selection for a particular application is generally done intuitively based on general rules of thumb, but not on a scientific or technical basis.

For example, in selecting a bit design for a directional application, the bit may be selected based on the general knowledge that small cutters perform better in a directional application. The specific details as to the reasons for, or extent of, the improved performance are not generally considered. It is generally known that certain bit profiles steer better; it is known that certain cutter shapes steer better; and it is known that back rake can affect steering performance.

Generally speaking, when a bit selection is made, the selection is based on a combination of these intuitive reactions as well as empirical data that is obtained in the past from using certain bits in these environments. In selecting a bit, certain parameters regarding the drilling system and formation are also generally known, such as the motor torque requirements and performance, the motor RPM the range of compressive strength in the formation, and the range of ROP for a particular bit design. Using these parameters, an intuitive analysis is made where, for example, the number of blades needed is determined, the cutter sizes are determined, and the bit profile is determined. The approach has generally been purely intuitive. With the current bit selection process, twenty different bit designers may come up with twenty different combinations in a bit to achieve the final design.

In most drilling situations, it is usually desirable for the bit to achieve the maximum possible rate of penetration (ROP) through the formation. The rate at which the drill bit penetrates the formation is determined primarily by the formation characteristics, the design of the drill bit, and the characteristics of the drilling system used to drive the bit.

Some drilling systems, such as, for example, those that are employed to drill directional wells, drive the bit with a subsurface motor. The speed of rotation and the torque output of the motor are examples of operating characteristics of the motor itself that affect the drill bit ROP.

When the reaction torque of the bit against the formation exceeds the output torque capability of the motor, the bit will cease rotation. A number of factors affect the reaction torque value. These include the hardness, or compressive strength of the formation, the configuration of the engaging interface between the bit and the formation, and the magnitude of the forces driving the bit into the base of the bore hole. Of these factors, the weight on bit (WOB), which supplies the primary force driving the bit against the base of the well bore, is one of the most easily measured forces affecting the drilling process, and it is a force that can be conveniently monitored at the well surface during the drilling process.

With the bit off the bottom of the well bore, a condition in which there is essentially no weight on the bit, the reaction torque of the rotating drill bit is very small. As weight is applied to the bit, the reaction torque increases until the weight exceeds a value at which the speed of rotation and torque output begin to decrease. The relationship between the torque output of the bit and the WOB can be established for a given drill bit size and bit design operating in a specified formation.

In practice, the torque versus WOB curve for a specific bit is the most frequently employed guide to determine the operating conditions for the bit. Thus, where the maximum torque output from the bit is desired, the WOB is maintained at the level indicated by the curve to produce this maximum torque. Generally, maintaining maximum torque output at the bit produces the best ROP. This is not, however, always the case, and maintaining the maximum allowable weight on the bit does not necessarily produce the maximum torque in the bit.

The practice of using WOB to determine torque is only indirectly related to the primary objective of optimizing ROP. Maintaining an optimum output torque on the bit of a particular bit design does not necessarily produce the optimum ROP capable of being attained with the drilling system and well formation of the application.

SUMMARY OF THE INVENTION

A superior approach for optimizing the rate of penetration or effective directional drilling through a particular formation using a selected drilling system is to design a bit that will operate within the parameters of the drilling system and formation to provide the optimum ROP for all of the drilling applications. The ROP is a function of the depth of cut (DOC) and the rate of rotation, revolutions per minute, or RPM, of the drill bit. In designing, or selecting, a bit, the DOC of the bit is the preferred characteristic to evaluate when selecting the cutters, cutter placement, cutter rake, bit blade design, bit profile, and other bit features.

The present invention directs the initial effort in optimizing the ROP of a bit through a given formation with a given drilling system to the selection of the bit. The preferred bit is one in which the DOC is evaluated for optimum performance in the drilling system, drilling a specific well bore configuration in a specified formation.

In the process of designing the bit, a "basic" bit design is selected, and a curve showing the relationship between the predicted torque applied to the bit and the depth of cut is created for a formation having the applicable compressive strength. The curve is determined with the assistance of a computer modeling program. Curves may also be created for the bit showing the relationship between the DOC and the rate of rotation. By reference to the torque versus depth of cut chart, the torque value expected from a given depth of cut in a selected formation can be determined.

It may thus be appreciated that the method of the invention redirects the drilling process to the design of an optimum bit with the regulation of torque, WOB, and RPM within the limitations of the drilling system to produce the optimum ROP for a given formation type and/or drilling path.

A feature of the described process of the present invention is that the formation compressive strength may be estimated by monitoring the torque experienced during the actual drilling of the bore hole. If the actual torque encountered during the drilling matches the predicted torque on the torque versus depth of cut curve, the validity of the computer model is confirmed. The computer model may then be employed to estimate the compressive strength of the formation. This technique provides an alternative to the geomechanical method for determining compressive strength and also dispenses with the requirement for performing subsurface measurements to determine compressive strength.

In practicing the method, the first step is to gather the information regarding the application for the drill bit. This information includes the drilling system limitations or parameters such as torque output capacity of the downhole motor, speed of rotation or RPM of the motor, weight on bit limitations of the drilling assembly, and information regarding the expected formation compressive strength. Given the expected compressive strength of the formation and the expected rate of penetration of a basic bit, the depth of cut of the bit with a given bit RPM can be calculated using the computer modeling program.

A depth of cut versus RPM/ROP curve can be created for the expected RPM range and ROP range to determine a DOC range.

From these curves, a depth of cut versus torque curve can be created for the basic bit design.

In the computer modeling, changes can be made in the cutter size, shape, placement, composition, number of blades, bit profile, cone angle, etc., to evaluate the effect of these changes on the torque versus DOC curve.

A bit is selected using this process with a cutter and a blade design or profile that optimizes the bit performance within the given formation and within operating limitations of the drilling system.

During the actual drilling of the well bore, the torque encountered by the bit while attaining the calculated ROP may be compared with that predicted from the computer model. If the actual values correlate with the predicted values, the computer model can be validated and employed to predict other aspects of the formation, including compressive strength.

The object of the present invention is to set forth objective criteria for determining the optimum bit design for a specified application.

A feature of the invention is the manner of presenting the information for if selection by the bit designer. Displaying the relationship of torque versus depth of cut permits a simple presentation that facilitates bit design selection.

DESCRIPTION OF THE PREFERRED EMBODIMENTS

Figure 1:
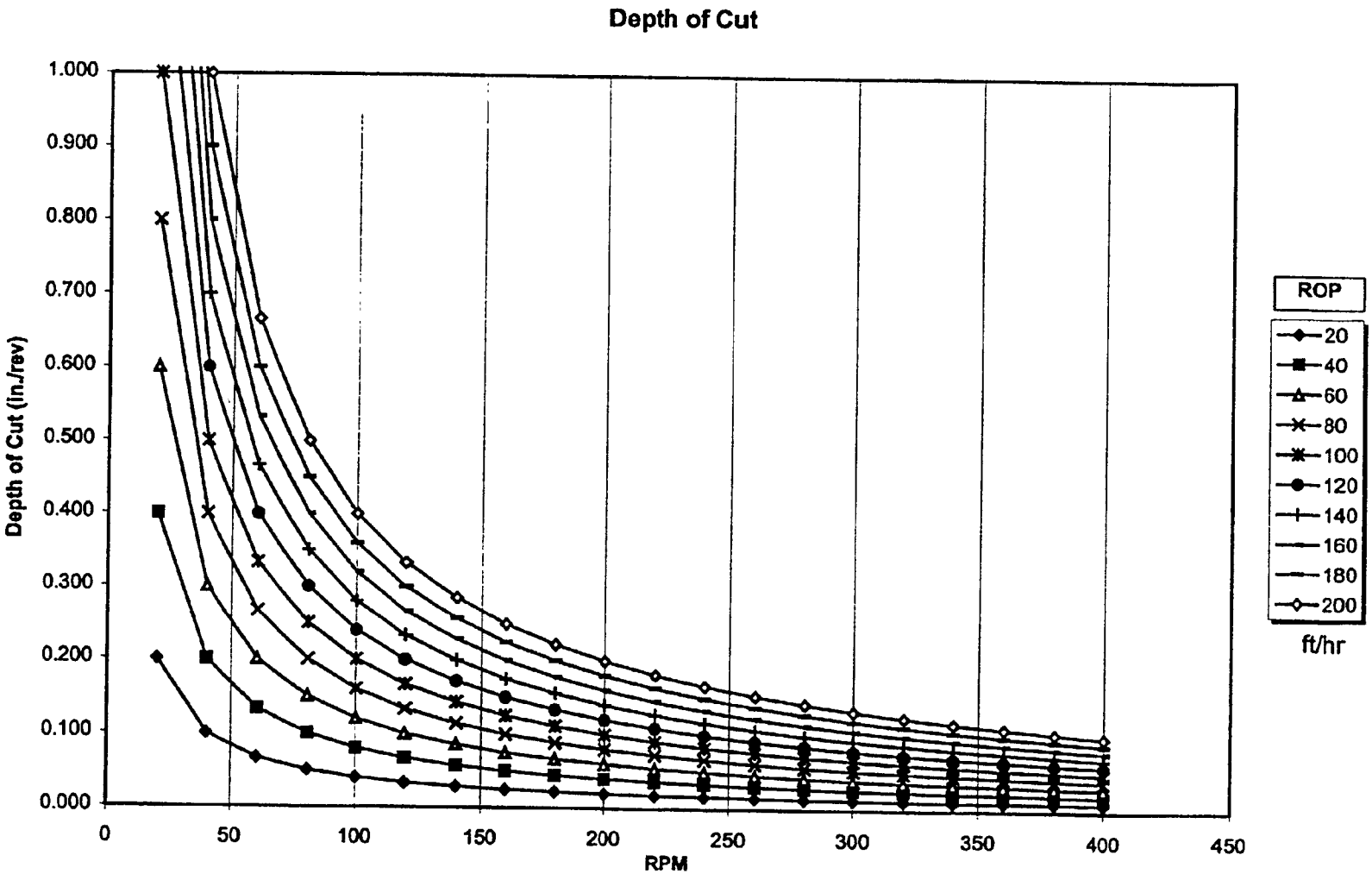
FIG. 1 is a family of graphs illustrating the relationship between speed of rotation of the bit (in RPM) and the DOC (in inches per bit revolution) for different rates of penetration (in feet per hour)

The process of the present invention begins by defining the parameters of the application. This entails primarily determining what the drilling system characteristics or features and formation characteristics and features. Information about the drilling system and formation may be obtained from actual drilling applications in which drilling systems were operated in similar formations. The drilling system is defined as a function of its operating characteristics and capabilities. These include range of bit rotation speed (RPM), range of WOB, range of subsurface motor torque, and range of rig torque in a rotary rig. The present invention permits design of a bit having an optimum torque curve based on the torque and other parameters of the drilling system and formations in which the bit is to be used. A torque curve is selected as the curve for evaluation because the torque is the typical limitation in monitoring a drilling application.

The objective of the invention in straight-hole drilling applications is to have a bit that can respond to the maximum torque available from the system and produce the maximum rate of penetration for the formation. Where directional drilling is required, the same bit must achieve or exhibit desired steering characteristics. Subsurface drilling motors used in directional drilling applications require a bit that can adequately deal with tool face fluctuations. In these directional applications, the bit must exhibit a smooth torque response, as well as provide the optimum ROP. The bit selection must take into account the application of the bit since the same bit may be used for drilling directionally, straight, and through different structures within the formation.

Maximum torque is not always the optimum torque to be applied to the bit in some situations. At some point in time in the drilling of the well, ROP may be a primary concern, and directional capabilities can be sacrificed in order to achieve the desired ROP. At other times, the primary consideration is the directional goal, and rate of penetration can beneficially be sacrificed.

Since it is common to employ the same bit to achieve both the directional and ROP requirements, the optimum bit will exhibit a balance of all of the different required characteristics, such as steerability, ROP, torque output, and other factors to achieve the desired objective. The bit design is a give-and-take process, and the design should be based on the best compromise of technically measured variables rather than being the result of a subjective, intuitive selection process.

Given that the limitations of the drilling system are known and the formation within which we are to drill is generally known, the next step in the process of the invention is similar to the first step normally taken in the prior art process of bit selection. A "basic" bit design is selected based on experience, general rules of thumb, and intuition.

The basic bit design selected for this example is an 8½-inch Security DBS FS 2645 polycrystalline diamond compact (PDC) bit. Design modifications are compared against this basic bit. In selecting a basic bit, variables can be selected using rules of thumb, such as starting with a bit having a selected number of blades, a certain bit profile, specific cutter sizes, and a specific back rake scheme. A computer modeling program is then used to obtain the relationship between a bit having these features and the torque curves resulting from use of the bit under certain conditions. A torque versus depth of cut relationship can be established from the computer model. New values for each variable can be inserted into the model to determine how the torque curve is affected. Visual evaluation of the effect of the changes can be quickly and directly made from the torque versus depth of cut curves.

The torque versus depth of cut curve is indirectly derived from the output of a computer model using the Amoco force balance program. The Amoco program is described in U.S. Pat. No. 5,042,596, incorporated herein for all purposes. In the method of the present invention, RPM, ROP, and rock strength values, based on the anticipated application, are input to the program, and the Amoco program calculates the expected torque (force imbalance) effect on the bit. RPM and ROP used in the model are used to determine DOC. The Amoco program is a force modeling program and was not designed specifically to provide a torque versus depth of cut curve. As a part of the present invention, the output from the Amoco program is used to calculate the torque versus depth of cut curve for use in the bit design.

The family of curves in FIG. 1 represent different ROPs for ease of interpretation. A formula rather than a curve could be used to set out the relationship between the variables; however, the curves provide readily comprehensible information for making the design selection. RPM and ROP for the application provide depth of cut, and from the specific curves generated for the design being considered, the depth of cut can be determined.

Figure 2:
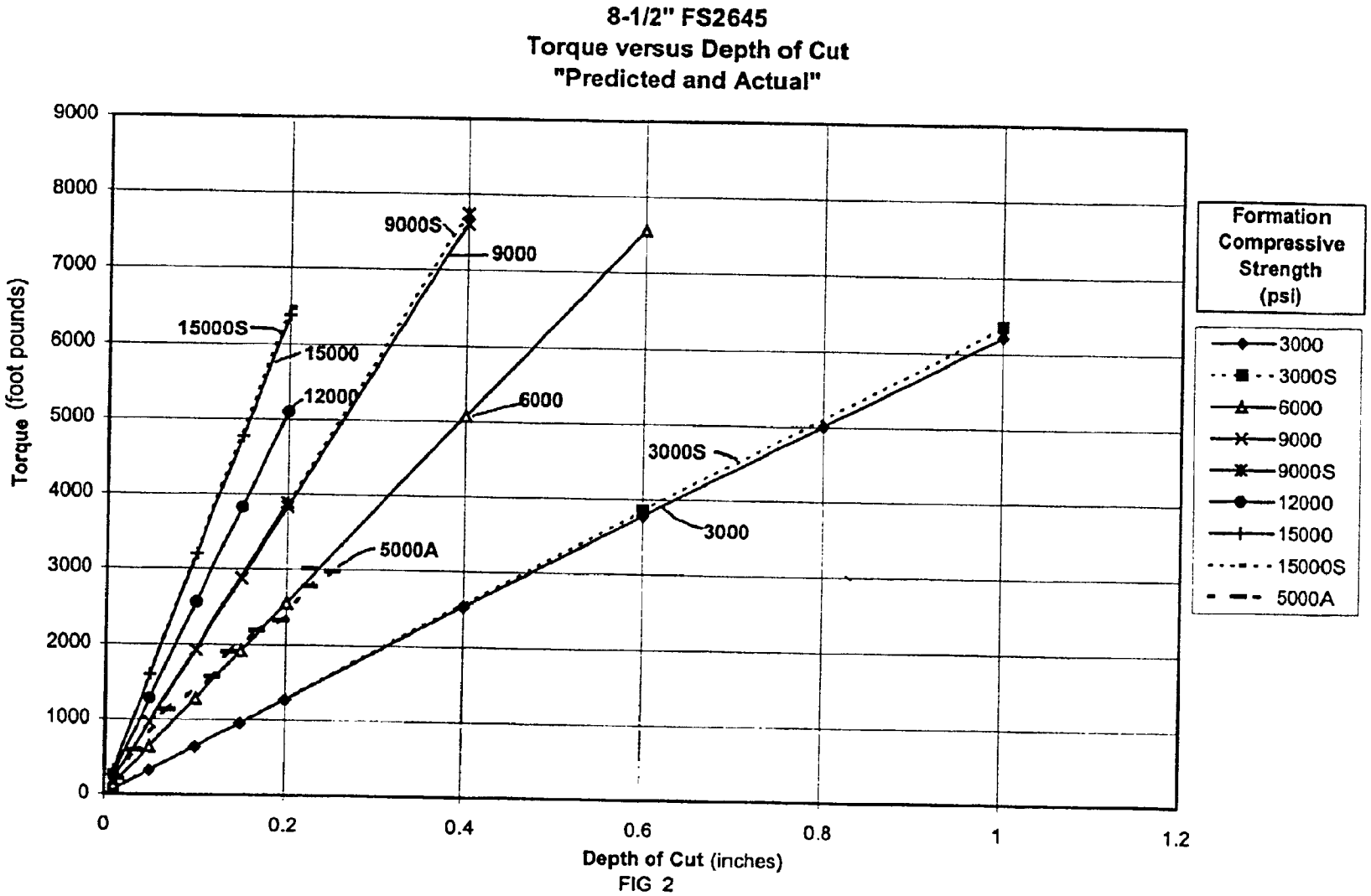
FIG. 2 is a family of graphs illustrating the relationship for a selected bit designed between DOC (in inches per revolution) and actual and predicted torque (in foot pounds) for different formation compressive strengths (in pounds per square inch (psi))

The compressive strength curve for the formation to be drilled (FIG. 2) provides a predicted output for that bit design. For example, with reference to FIG. 1, at 100 RPM and an ROP of 40 feet per hour, a depth of cut of 0.08 inch will be obtained. FIG. 2 shows a predicted torque versus depth of cut for several formation strengths. A predicted torque versus depth of cut curve for the particular bit design can be determined from FIG. 2 for a formation having the compressive strength represented in the family of curves.

In the laboratory test, a known strength rock and a known bit design (8½ inch FS 2645) were run with known parameters. All parameter values and the torque values were recorded. This specific bit design was run, and the laboratory instruments reported the torque, RPM and ROP. The compressive strength of the rock sample was one of the known parameters. From the ROP and the RPM, depth of cut was calculated and plotted versus torque, as illustrated in FIG. 2.

Figure 2A:
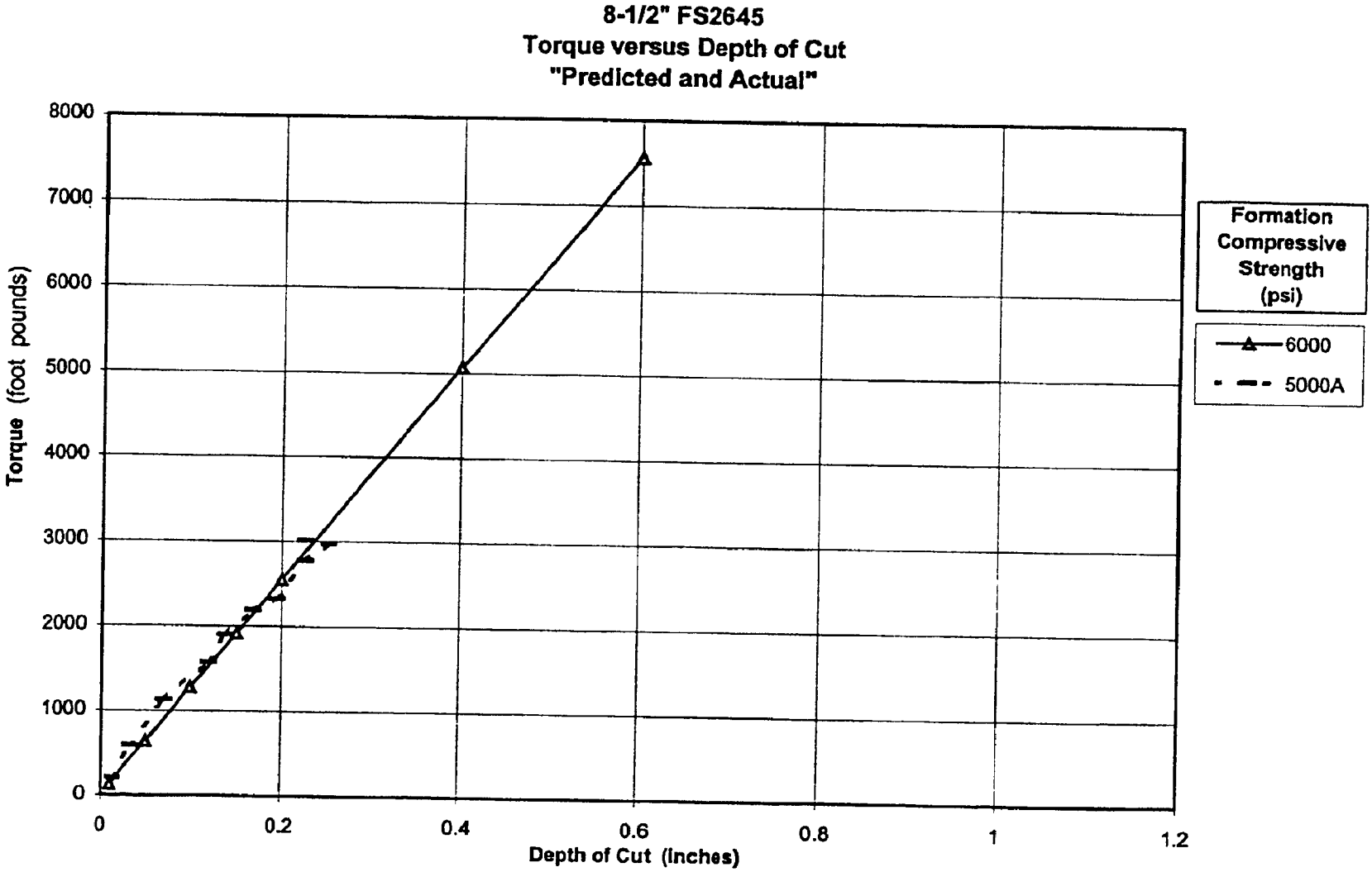
FIG. 2A is an illustration of one actual and one predicted torque curve taken from the illustration in FIG. 2.

FIG. 2A illustrates a curve for an actual depth of cut for an 8½inch FS 2645 bit operating on a compressive strength formation of 5000 psi. This latter curve is designated as the 5000A curve. An actual lab test was run using an 8½ inch FS 2645 drill bit drilling rock having a compressive strength of 5000 psi. The resulting curve of torque versus depth of cut for the actual test overlaps the curve for the 6000 psi formation. FIG. 2A confirms that the curve of the actual drilling results closely tracks that of the predicted curve for approximately the same compressive strength formation.

To optimize the bit design, where, for example, our application was for a 3000 psi compressive strength formation, we would generate a predicted torque versus depth of cut curve in a 3000 psi formation. This would produce a curve that would serve as the base design curve. For example, with reference to FIG. 2, the 3000 psi curve would be the base design using standard cutters. The 3000 S curve is the curve resulting when scribe cutters are put in the center of the cutting structure. The use of the scribe cutters produces a torque curve that is different from the base curve as represented by the dotted line representation of the scribe curve. Bit profile could be altered to determine how the curve of torque versus depth of cut is changed, the back rake scheme could be changed to determine how the curve is changed, and so forth.

In a preferred application of the process, the different variables in the bit design are selectively changed to produce multiple curves within a range of compressive strengths. The objective is to have the slope of the torque versus depth of cut curve as small or as flat as possible so that the greatest depth of cut with the least application of torque may be obtained. The goal is to get the maximum depth of cut with the least amount of torque generated, which, in subsurface motor drives, optimizes the motor torque. This approach also provides a smoother torque response as the curve becomes flatter. The importance of this feature may be seen from the following example. Assuming a very high compressive strength—for example, 15,000 psi as shown on the steepest slope curve in FIG. 2—at a depth of cut of 0.1 inch, the torque is about 3200 foot-pounds. At a depth of cut of 0.2 inch, the torque rises to almost 6,500 foot-pounds. A 0.10 inch increase in depth of cut doubles the torque. This is significant because the subsurface motor would be stalled at a very small increase in depth of cut. Accordingly, the design selection is one that tends to flatten the curve as much as possible to optimize the bit in this application. The variable could be number of blades, bit profile, cutter rake, etc.

With regard to these variable design changes, each change is entered in the computer model, and the corresponding torque versus depth of cut result is evaluated. With each modified design the Amoco model is employed to determine output torque versus the value of the parameters being examined. The resulting curves can be evaluated based on the changes in the design.

Figure 3:
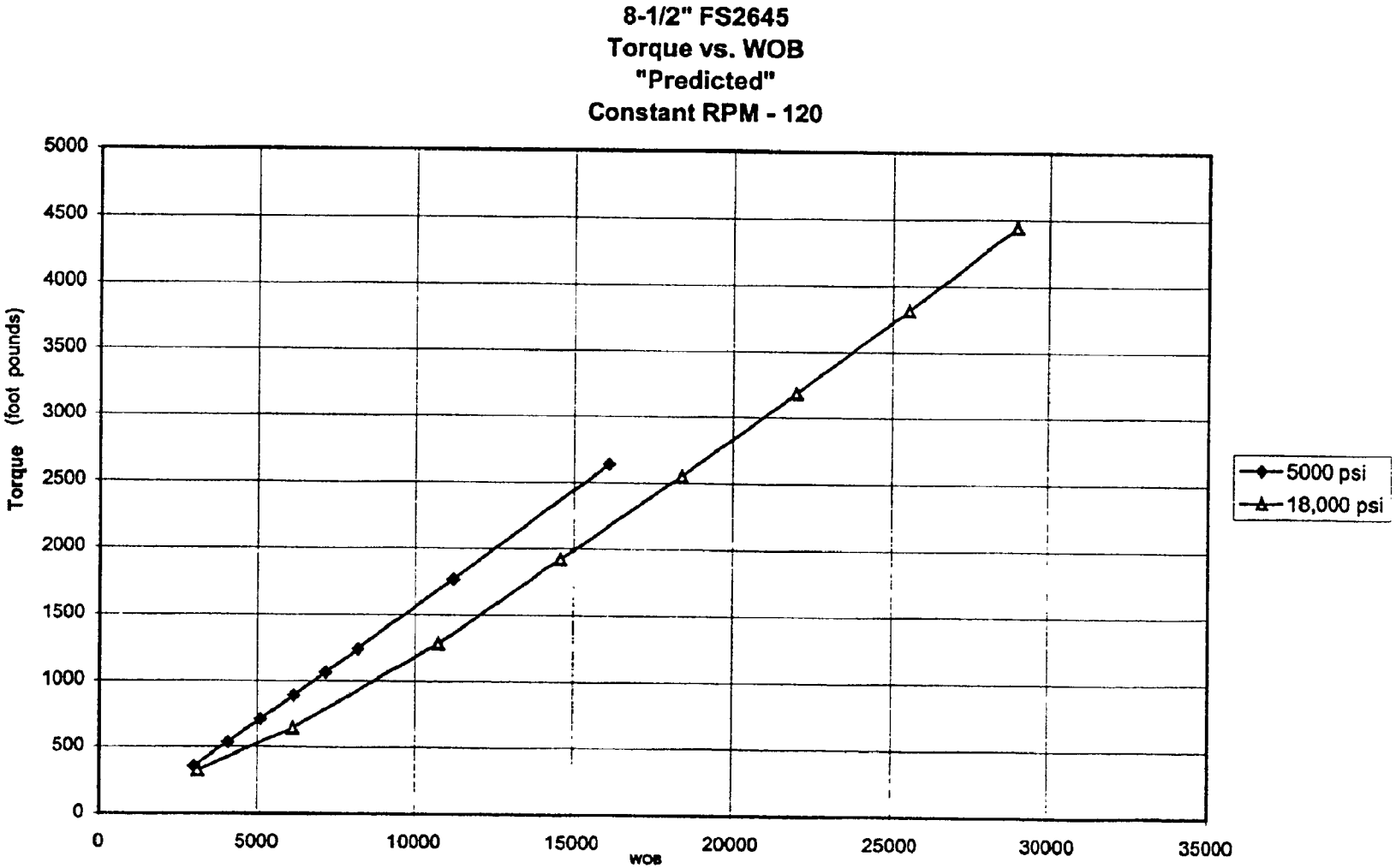
FIG. 3 is a graph illustrating the relationship for a selected bit design between WOB (in pounds) and predicted torque (in foot pounds) for a bit rotating at a constant rate (in RPM) in different strength formations (measured in psi)

FIG. 3 is a chart showing the torque versus weight on bit curve comparing the predicted torque and the actual torque experienced during the laboratory test of the 8½ inch FS 2645 bit referred to previously. The industry typically employs a torque versus weight on bit representation for bit selection. FIG. 3 shows the close correlation between the predicted torque as a function of weight on bit versus the actual torque as a function of weight experienced in the laboratory test.

Figure 4:
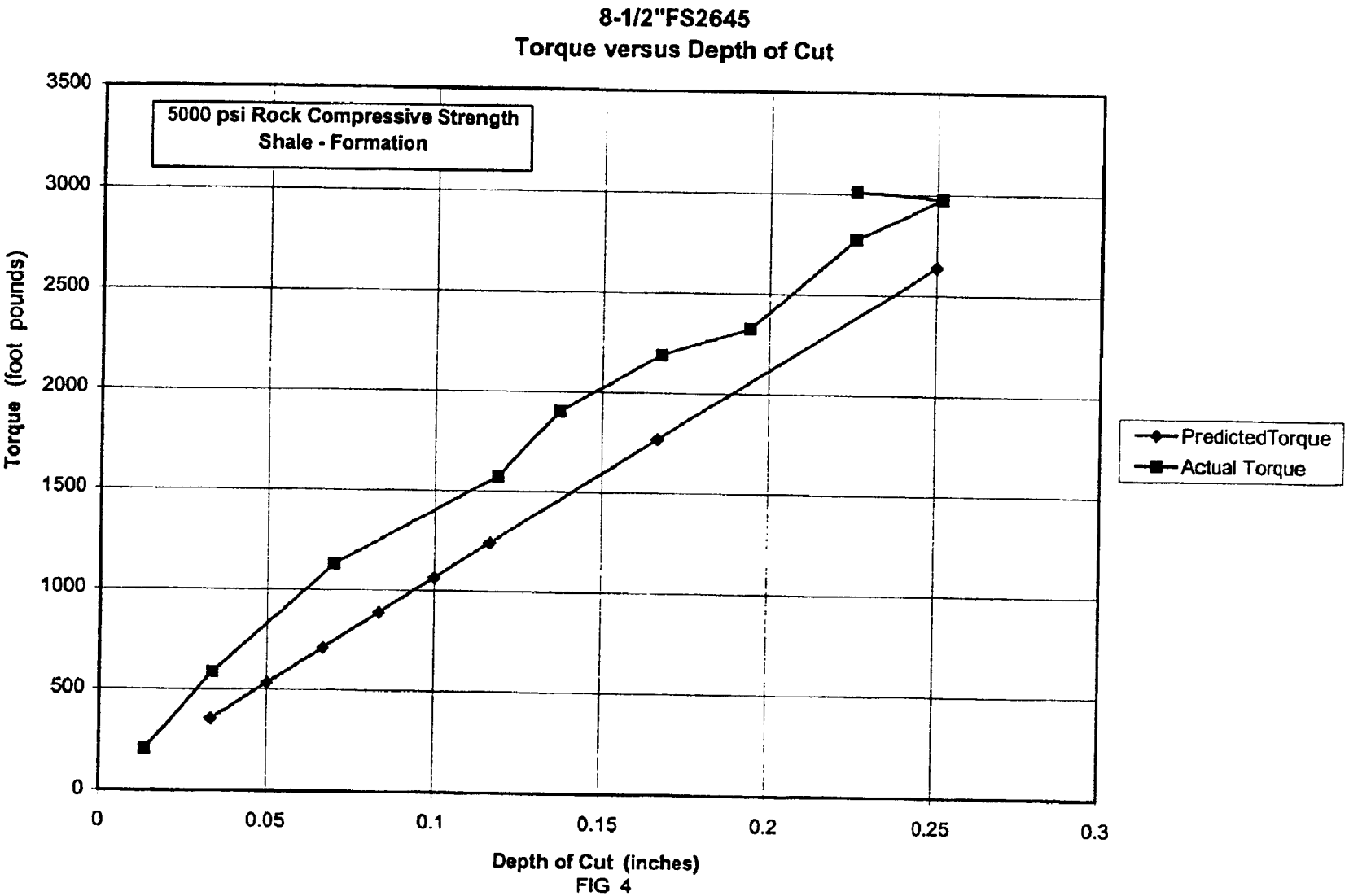
FIG. 4 is a family of graphs illustrating the relationship for a selected bit between the DOC (in inches per revolution) and the torque (in foot pounds) for actual torque and predicted torque operating in a formation having a specified composition and compressive strength.

FIG. 4 illustrates torque represented as a function of depth of cut for the 8½ inch FS 2645 bit used in the test. The chart shows the predicted torque from the computer model and the actual torque experienced for the depth of cut in the laboratory test. The curves also show dose correlation. The close correlation of this set of curves is to be expected since the depth of cut and weight on bit are directly proportional to one another.

In the application of this system, depth of cut and weight on bit are directly proportional. Correlation between the predicted slope and the actual torque curve in FIGS. 3 and 4 is the same. The correlation validates the process of examining depth of cut rather than weight on bit. The difference in the approaches is that in looking at the torque versus weight on bit curve (FIG. 3), the curve is valid only for an RPM of 120. A set of curves showing variations for every different parameter would be required for the bit evaluation; however, comparing the information in FIG. 4, all that must be known is depth of cut, which is a combination of RPM and ROP. Depth of cut is a straightforward calculation directly producing the curve of FIG. 4. No reference is required to ROP or RPM. ROP and RPM directly correlate with depth of cut and torque, permitting the use of a single torque versus depth of cut curve that inherently incorporates the ROP and RPM variable.

It will be appreciated that various modifications can be made in the design, construction and operation of the present inventions without departing from the spirit or scope of such inventions. Thus, while the principal preferred construction and mode of operation of the inventions have been explained in what is now considered to represent their best embodiments, which have been illustrated and described herein, it will be understood that within the scope of the appended claims, the inventions may be practiced otherwise than as specifically illustrated and described.

What is claimed is:

1. A method for improving a drill bit assembly design for drilling a well bore section, comprising:

determining a range of operating parameter values for a drilling system to be employed to drill said well bore section, determining characteristics of the formation along a trajectory through which said well bore section is to be drilled, calculating a first rate of penetration through said well bore section for a first drill bit assembly design to be employed with said drilling system for drilling said well bore section, said calculated rate of penetration being determined as a function of calculating with operating parameter values within said range of operating parameter values, modifying a depth of cut parameter of said first drill bit assembly design to provide a subsequent drill bit assembly design, calculating a second rate of penetration through said well bore section for said subsequent drill bit assembly design to be employed with said drilling system for drilling said well bore section, said second rate of penetration for said subsequent drill bit assembly being determined as a function of applying operating parameters within said range of operating parameters, and selecting a selected drill bit assembly design from said first and subsequent drill bit assembly designs having the calculated rate of penetration.

2. A method for improving a drill bit assembly design as defined in claim 1, comprising repeating the steps of modifying a depth of cut parameter and calculating, for a subsequent drill bit assembly design, the rate of penetration through said well bore section until obtaining a selected drill bit assembly design having a calculated rate of penetration through said well bore section that is greater than said first calculated rate of penetration of said first drill bit assembly design through said well bore section.

3. A method as defined in claim 1 further comprising building a drilling bit assembly having said selected drill bit assembly design.

4. A method as defined in claim 1 further comprising drilling said well bore section with a drilling bit assembly having said selected drill bit assembly design.

5. A method as defined in claim 1 wherein said operating parameter values include torque values.

6. A method as defined in claim 1 wherein said operating parameter values include torque and rate of revolution values.

7. A method as defined in claim 1 wherein said operating parameter values include torque, rate of revolution and weight on bit values.

8. A method as defined in claim 1 wherein said trajectory includes a curving section.

9. A method as defined in claim 1 wherein said first calculated rate of penetration through said well bore section for a first drill bit assembly design is calculated using a computer modeling program.

10. A method as defined in claim 9 further comprising:

determining a depth of cut verses predicted torque relationship for said selected drill bit assembly design using said computer modeling program, and drilling said well bore section with a drilling bit assembly having said selected drill bit assembly design.

11. A method as defined in claim 10, further comprising comparing the actual torque values encountered while drilling said well bore section with a drilling bit assembly having said selected drill bit assembly design with the predicted torque values in said depth of cut verses predicted torque relationship for evaluating a first characteristic of said formation.

12. A method as defined in claim 11 wherein said first characteristic of said formation comprises the compressive strength of said formation.

13. A method as defined in claim 11 wherein the torque values encountered when drilling said well bore section during a first rate of penetration are compared with the predicted torque values for said selected drill bit assembly design at a rate of penetration equal to said first rate of penetration.

14. A method as defined in claim 13 wherein said first characteristic of said formation comprises a compressive strength of said formation.

15. A method as defined in claim 11 further comprising predicting a characteristic of said formation by comparing said actual torque values and said predicted torque values while drilling said well bore section.

16. A method as defined in claim 15 wherein said predicted characteristic is formation compressive strength.

17. A method for matching a drilling bit assembly to a specific drilling application, comprising:

determining a range of system operating parameters for a drilling system to be employed to drill a well bore section through a selected medium, selecting a basic drilling bit assembly design having a first set of bit characteristics, using a computer modeling program to determine a first set of torque characteristics of a bit of the basic drilling bit assembly design going through the selected medium, said computer modeling program evaluating reaction torque in a bit of the basic drilling bit assembly design as a function of the characteristics of the selected medium, the weight on a bit of the basic drilling bit assembly design, the rate of rotation of a bit of the basic drilling bit assembly design and/or the rate of penetration of a bit of the basic drilling bit assembly design through the selected medium, modifying a depth of cut characteristic of the basic drilling bit assembly design to produce a modified drilling bit assembly design with a greater depth of cut than the basic drilling bit assembly design, said modified bit assembly design being operable within said range of system operating parameters for said drilling system, using said computer modeling program to determine a second set of torque characteristics of the modified bit assembly design, expressing representations of depth of cut verses torque values for said basic drilling bit assembly design and said modified drilling bit assembly design, and selecting a drilling bit assembly design using information from the expression of the depth of cut verses torque values.

18. A method as defined in claim 17 wherein said depth of cut characteristics are modified by changing a profile of said basic drilling bit assembly design.

19. In method as defined in claim 17 wherein said depth of cut characteristics are modified by changing a blade design of said basic drilling bit assembly design.

20. A method as defined in claim 17 wherein said depth of cut characteristic are modified by changing a cutter rake of a cutter of said basic drilling bit assembly design.

21. A method as defined in claim 17 wherein said depth of cut characteristics are modified by changing a cutter configuration of said basic drilling bit assembly design.

22. A method as defined in claim 17 wherein said depth of cut characteristics are modified to obtain the maximum rate of penetration for said modified drilling bit assembly design.

23. A method for optimizing the drilling of a well bore section, comprising:

determining a range of available operating capabilities including applied torque, speed of rotation and weight on bit for the drilling system to be used to drill said well bore section, determining the physical characteristics of the formation through which said well bore section is to be drilled, selecting a first basic bit design for use with said drilling system, calculating the torque required to move a bit of said first basic bit design against said formation, calculating the rate of penetration through said formation of a bit having said first basic bit design, determining a depth of cut verse torque relationship for a bit having said first basic bit design penetrating said formation, modifying a feature of said first basic bit design to provide a second bit design, calculating the torque required to move a bit of said second bit design against said formation, determining a depth of cut verses torque relationship for a bit of said second bit design, and selecting from said depth of cut verses torque relationships for bits of said first and second bit designs, a bit design for use with said drilling system.

24. A method for optimizing the drilling of a well bore as defined in claim 23 wherein said depth of cut verses torque relationships are derived in part from a computer analysis of said first and second bit designs.

25. A method for optimizing the drilling of a well bore as defined in claim 24 wherein said computer analysis employs information regarding rate of bit penetration, formation hardness and rate of bit revolution to calculate the expected torque on a bit design.

26. A method for optimizing the drilling of a well bore as defined in claim 24 wherein rate of penetration and rate of bit revolution are employed to calculate a depth of cut for said bit designs.

27. A method for optimizing the drilling of a well bore as defined in claim 23 wherein said basic bit design is modified to produce a bit design having a greater depth of cut for a given torque than is produced by said basic bit design at said given torque.

28. A method for optimizing the drilling of a well bore as defined in claim 23, comprising:

repeatedly modifying a feature to provide multiple bits of multiple bit designs, repeatedly determining the torque required to move said bit of said multiple bit designs against said formation, repeatedly determining a depth of cut verses torque relationship for said multiple bit designs, and selecting a preferred bit design from said depth of cut verses torque relationships for said multiple bit designs for use with said drilling system.

29. A method as defined in claim 23 further comprising determining the torque for multiple bit designs as a function of formations having different compressive strengths.

30. A method as defined in claim 23 further comprising modifying said bit designs to obtain a bit design optimizing depth of cut with the least amount of torque.

31. A method as defined in claim 23 further comprising modifying said bit designs to obtain a bit design producing an optimum rate of penetration for a well bore section having both a linear and a curved trajectory.

32. A method as defined in claim 23 further comprising evaluating the formation compressive strength by monitoring the torque experienced during the drilling of said well bore section.

33. A method as defined in claim 23 further comprising evaluating a characteristic of a first formation by comparing the torque encountered at a first rate of penetration of said first formation of a bit of said selected design with a predicted torque for a bit of said selected design operating at a depth of cut equivalent to said first rate of penetration.

* * * * *